United States Patent [19]

Anliker

[11] Patent Number: 4,829,737

[45] Date of Patent: May 16, 1989

[54] DEVICE FOR BUILDING SLABS FROM BUILDING BLOCKS

[76] Inventor: Anton Anliker, Wasserstapfe 6, 7940 Riedlingen, Fed. Rep. of Germany

[21] Appl. No.: 30,864

[22] PCT Filed: Jun. 5, 1986

[86] PCT No.: PCT/DE86/00237

§ 371 Date: Feb. 9, 1987

§ 102(e) Date: Feb. 9, 1987

[87] PCT Pub. No.: WO86/07403

PCT Pub. Date: Dec. 18, 1986

[30] Foreign Application Priority Data

Jun. 10, 1985 [DE] Fed. Rep. of Germany ..... 3520788

[51] Int. Cl.[4] ..... E04G 21/22; E04C 2/04

[52] U.S. Cl. ..... 52/749

[58] Field of Search ..... 52/749

[56] References Cited

U.S. PATENT DOCUMENTS

Re. 28,305 1/1975 Williamson ..... 52/749

*Primary Examiner*—John E. Murtagh

*Attorney, Agent, or Firm*—Spencer & Frank

[57] ABSTRACT

A method for building wall slabs (45) from building blocks (21), in particular for the partial prefabrication of buildings, is further developed, with the aim of further rationalisation and quality improvement, in that the building blocks (21) of each individual layer are first laid out in a row, taking into account possible mutual spacings, and then placed together in one movement with the upper side downwards. The associated device consists of a horizontally movable gantry framework, on which a turnover table (20) is provided which is attached winglike to a horizontal shaft (17) and has a clamping device (25,26) for a layer of building blocks (21), with the shaft (17) extending parallel to the wall slab (45), being accommodated, at its ends, in bearings which can be moved vertically, and having a drive for the swivelling movement through 180°. The building blocks are laid onto the turnover table (20) at a convenient working height with a suitable crane. All of the other operations run fully automatically and are in an interlinked timing sequence, including the mortar coating, for which a special auxiliary device is provided.

7 Claims, 3 Drawing Sheets

IV
VI
VI
IV
1
6
7
10
11
12
13
14
17
18
19
19
20
20
22
22
25
26
32
33
34
38
39
41
42
43
45
46
47
47
48
49
49
50

DEVICE FOR BUILDING SLABS FROM BUILDING BLOCKS

BACKGROUND OF THE INVENTION

The invention relates to a method and a device for building wall slabs from building blocks, with several building blocks, intended for arranging within a layer, being connected to one another and turned over together by fastening on a bearer and being brought with the upper side downwards into their final position in the wall slab.

Such a method is known from the British Patent Specification No. 317,708. Firmly clamping the building blocks on a bearer plate by means of screw clamps and turning over the bearer plate requires heavy manual work and at least two persons. A frame for the placing on of the bearer plate must be changed after applying each layer of building blocks and dismantled and reconstructed after a wall is finished.

The German Offenlegungsschrift No. 2,044,661 describes a mechanical method for building walls, with the building blocks being firmly clamped in a row on an angle rail. This angle rail is pivotable through 90° and mounted on a bearer, with the swivel axis running horizontally in the longitudinal direction. However, the mobility of the bearer in several directions and its shaking movements prevent dimensionally accurate work. The mortar is squeezed away at the side. Placing new building blocks onto the angle rail is made difficult by the inaccessibity of the angle rail.

SUMMARY OF THE INVENTION

In contrast, the object of the invention is to propose a method and a device for placing building blocks more quickly and more accurately and to rationalise this work further. The invention is to make possible to manufacture wall slabs of different size while using different building blocks, with recesses, such as, for example, window and door openings, also being provided in the wall slabs.

This object is achieved by a method which is characterised according to the invention in that the building blocks are turned over about a vertically movable axis extending parallel to the wall slab and are then placed into a prepared mortar bed by lowering to a predetermined height. The axis or shaft of the bearer is fixed in the horizontal direction, so that the accurate locating of the building blocks above the previously laid layer results automatically. Vertically lowering the turned-over blocks hanging on the bearer to a precisely predetermined height results in mortar seams of uniform thickness and the mortar can penetrate into the vertical channels of the building blocks. The bearer can be very long, for example 8 metres, and thus ensures a high output.

According to the invention, a suitable device for implementing the described method consists in the fact that a horizontally movable gantry framework is provided, that the bearer is a turnover table attached winglike to a horizontal shaft, and that the shaft, at its ends, is accommodated in bearings which are guided in a vertically adjustable manner on the gantry framework and each has a drive for a swivelling movement through 180°.

The building blocks are placed with very high accuracy by the turning over and the precise mounting of the turnover table. The bearings of the turnover table are vertically guided on the gantry framework and can be set accurately for height. The individual height stages are accurately preprogrammed in accordance with the height of the building blocks used, and after every placement operation the turnover table travels downwards again or—in the case of the lowermost layers—upwards into its initial position at a convenient working height for loading with building blocks. A further feature of the method is therefore that the row of blocks laid out on the turnover table for placement is lifted up or lowered with the turnover table and is placed by turning over after the appropriate height has been reached.

The clamping device for fixing the building blocks on the turnover table consists of a stop bar, attached to the turnover table in the longitudinal direction, and a plurality of clamping jaws which press transversely to the stop bar. The stop bar and the clamping jaws are preferably provided with a hard-elastic coating or are made of a wear-resistant, elastic material to prevent the clampedin blocks from slipping off. In any case, the clamping must be so effective that it withstands the full weight of the blocks and therefore supports the latter in a suspended manner.

The clamping jaws are preferably driven by means of individual lifting cylinders which can be actuated together, for example pneumatic lifting cylinders which are connected to a common compressed-air line. The lifting cylinders and the clamping jaws are expediently inclined towards the turnover table in the feed direction.

Special guide members for the clamping jaws can be attached to the turnover table which absorb the weight forces or prevent the jaws turning about the piston rod. Since the stroke of the clamping jaws is limited, the stop bar, for working building blocks of different width, is preferably attached in such a way that it is adjustable parallel to itself in the transverse direction on the turnover table.

The mobile gantry framework can have a supply base for building blocks and an overhead travelling crane with a grab for individual building blocks. The building blocks, normally delivered on pallets, are deposited on the supply base. The crane preferably has a bridge which can be moved on the gantry framework parallel to the wall slab and on which a travelling crab can be moved in the transverse direction. The worker, by means of this crane, removes individual building blocks or several building blocks from the pallet and places them onto the turnover table. In the case of window openings, the row of building blocks, which form a layer, may have appropriate gaps. When the layer of blocks is being clamped, the clamping jaws which do not meet resistance run into their end position. The arrangement is made in such a way that each block is gripped by at least one of the clamping jaws arranged together in a row.

Since the device as a whole can work as quickly as the turnover table can be loaded, it is proposed as an alternative for this that the turnover table is provided with a roller conveyor which conveys in the longitudinal direction and is loaded from one end, that is, from the side of the gantry framework. For example, a special loading trolley could be provided which has a conveyor belt on which the blocks are delivered one after the other. The worker then only needs to distribute and correctly position the blocks on the roller conveyor of the turnover table. If the turnover table is a grid of transversely running bars, the rollers can be arranged between the bars and be lowerable selectively. The turnover table could also always be loaded in its lowermost vertical position. In this case, the roller conveyor can be arranged to be stationary.

Finally, it is proposed that a mortar-application device, guided on a horizontal frame vertically movable on the gantry framework, can be moved backwards and forwards above the wall slab in the longitudinal direction. In particular, the mortar-application device can have a mortar-supply container and a mortar discharge pipe which can be swivelled about a vertical axis and is in one swivelling position during the outward travel and in the other swivelling position during the return travel. This yields two mortar beads lying next to one another. When the layer of blocks presses down on it, this local accumulation of mortar is adequately distributed. The mortar quantity discharged per unit time can be set by a slide at the discharge pipe or by the speed of a screw conveyor arranged in the latter. The movement of the mortar-application device is preferably controlled automatically; it therefore starts automatically, for example after the placement of a layer of blocks, while the turnover table moves back.

Another further development of the mortar-application device is that, during the longitudinal movement above the wall slab, the mortar application can be controlled by means of a sensor, for example a photocell, as a function of the presence or lack of building blocks in the relevant layer. This ensures that the mortar feed is interrupted when the device is travelling over window openings and at the beginning or end.

BRIEF DESCRIPTION OF THE DRAWINGS

An exemplary embodiment of the invention is described below with reference to the drawings, wherein in detail.

DETAILED DESCRIPTION ON THE PREFERRED EMBODIMENT

Figure 2:
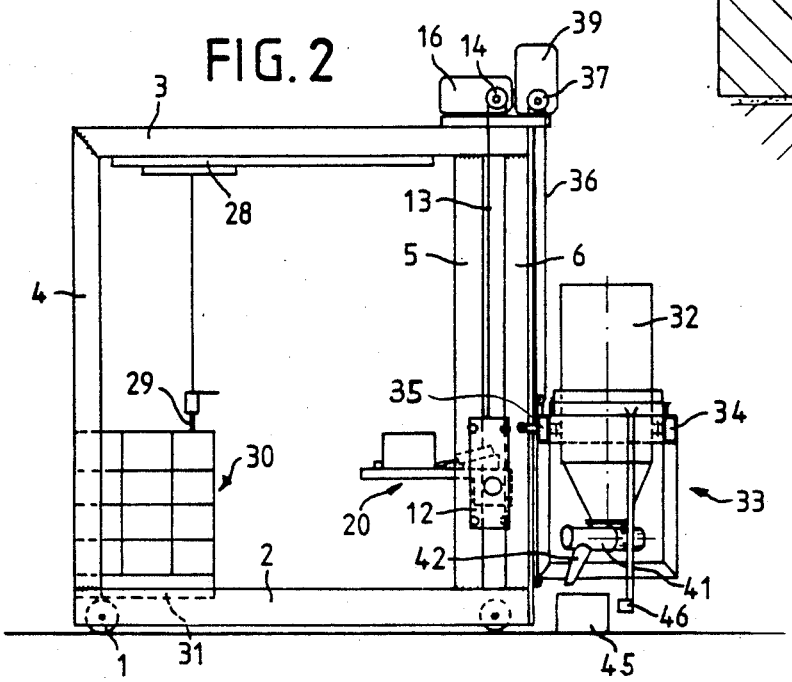
FIG. 2 shows a side view of a device for building wall slabs which contains the turnover table according to FIG. 1.
Figure 4:
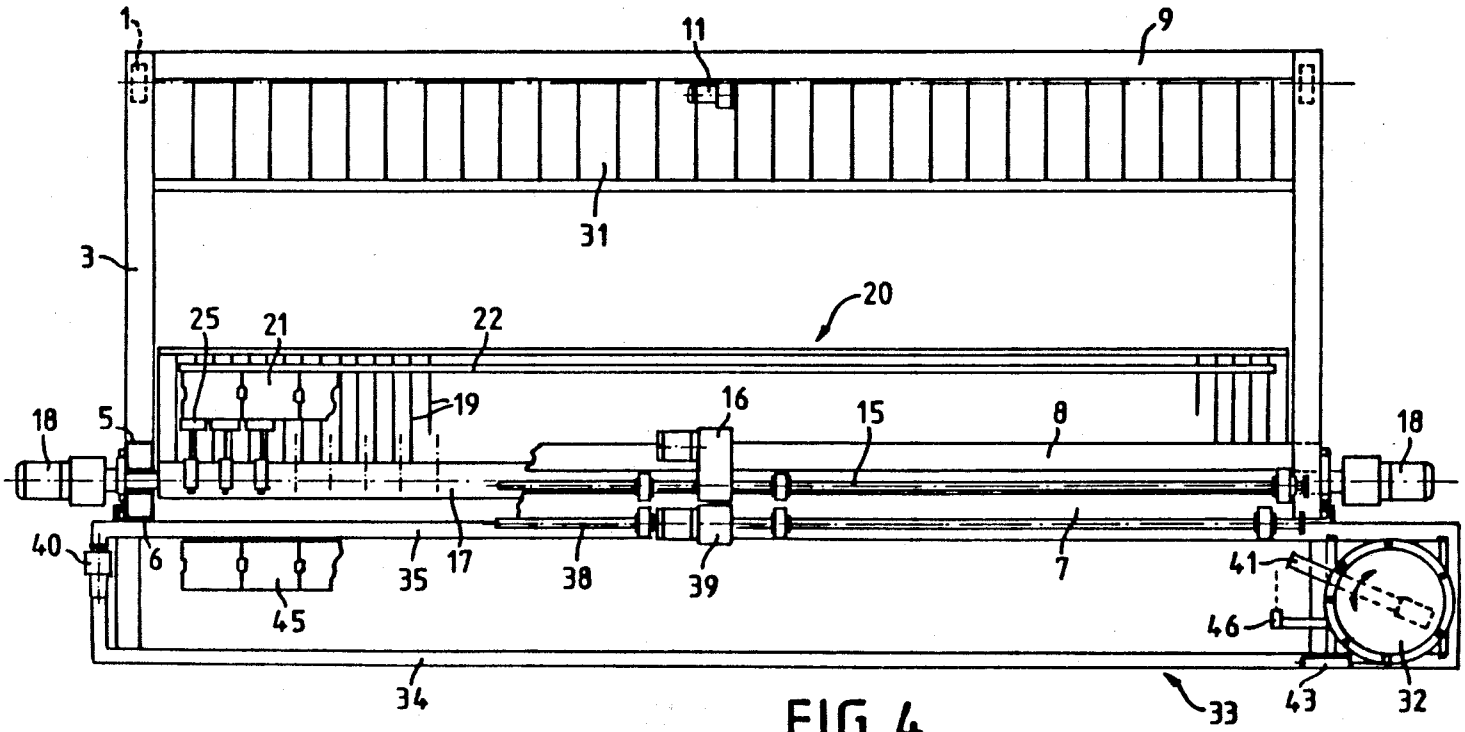
FIG. 4 shows a plan view of the device according to FIG. 3, with framework parts being broken away according to section line IV—IV.
Figures 3, 5, 6:
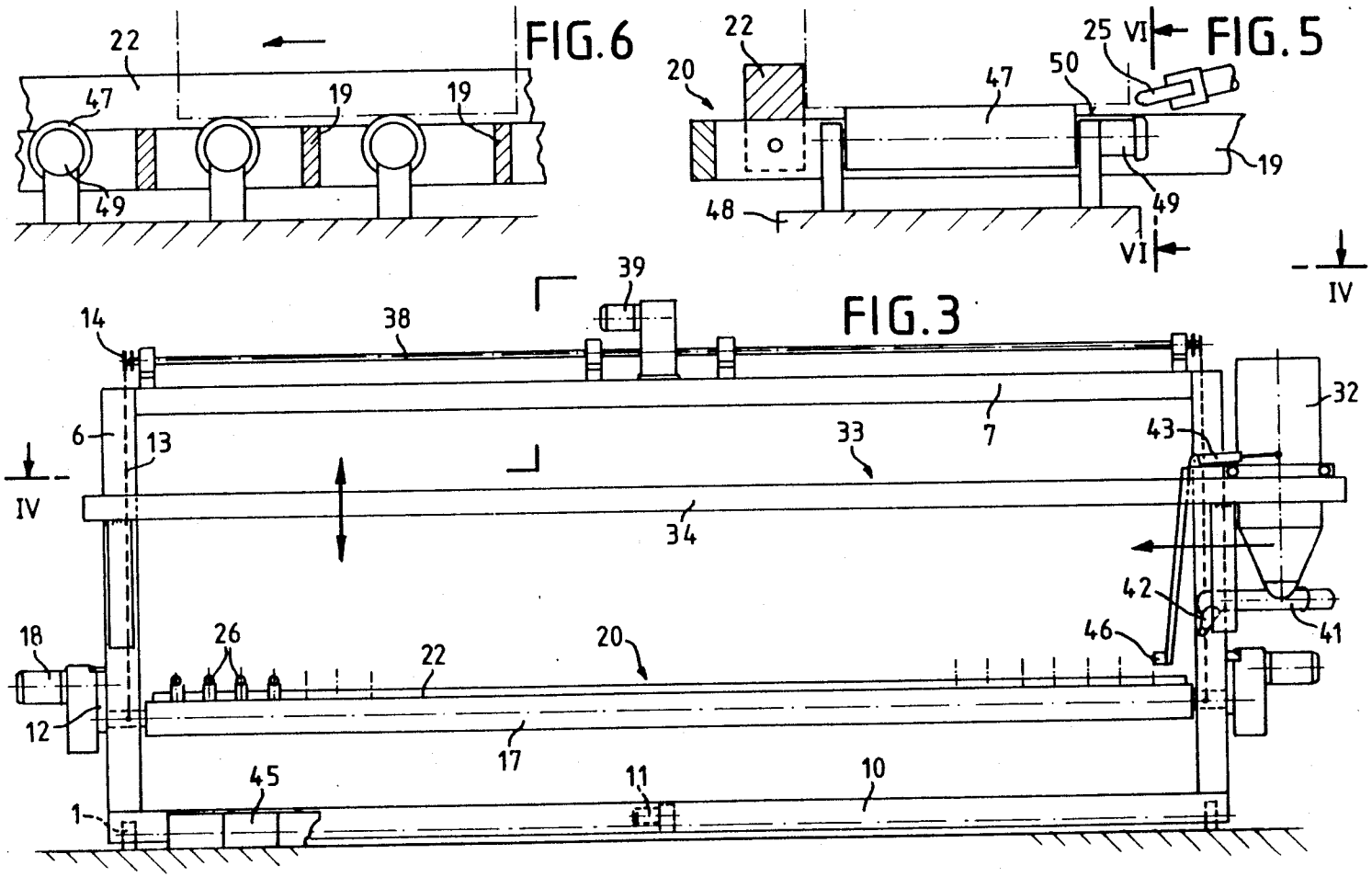
FIG. 3 shows a front view of the device according to FIG. 2, as viewed in the direction of movement.
FIG. 5 shows a partial cross-section of the turnover table to an enlarged scale and with a conveyor roller.
FIG. 6 shows a longitudinal section according to section line VI—VI in FIG. 5.

A square gantry framework is apparent from FIGS. 2 to 4 which consists of two square side frames which can be conveyed on travelling rollers 1 and are connected to one another by cross girders. The side frames consist of a lower and upper longitudinal girder 2 and 3 and of three supports 4, 5 and 6 of which the latter two are at a slight distance from one another and are designated together below as a double support. Two upper cross girders 7 and 8 which are drawn closely together correspond to the double support, and an upper cross girder 9 and a lower cross girder 10 are provided in the area of the supports 4. A lower cross connection in the area of the double supports is dispensed with. A travelling mechanism 11 is arranged on the cross girder 10.

Respective bearing plates 12 are guided on the outside of the two double supports 5 and 6 in a vertically movable manner by means of small rollers. These bearing plates hang on chains 13 which are placed over chain wheels 14 at the top. The latter are mounted on the framework and are driven by a geared motor 16 via a shaft 15 which extends along the cross girders 7 and 8 over the entire width of the framework. Extending between the bearing plates 12 is a turnover shaft 17 which is square in cross-section, and the ends of which are engaged by powerful geared motors 18 (not shown in FIG. 2) mounted on the bearing plates 12. A grid-shaped turnover table 20 consisting of flat bars 19 is welded to the turnover shaft 17.

Figure 1:
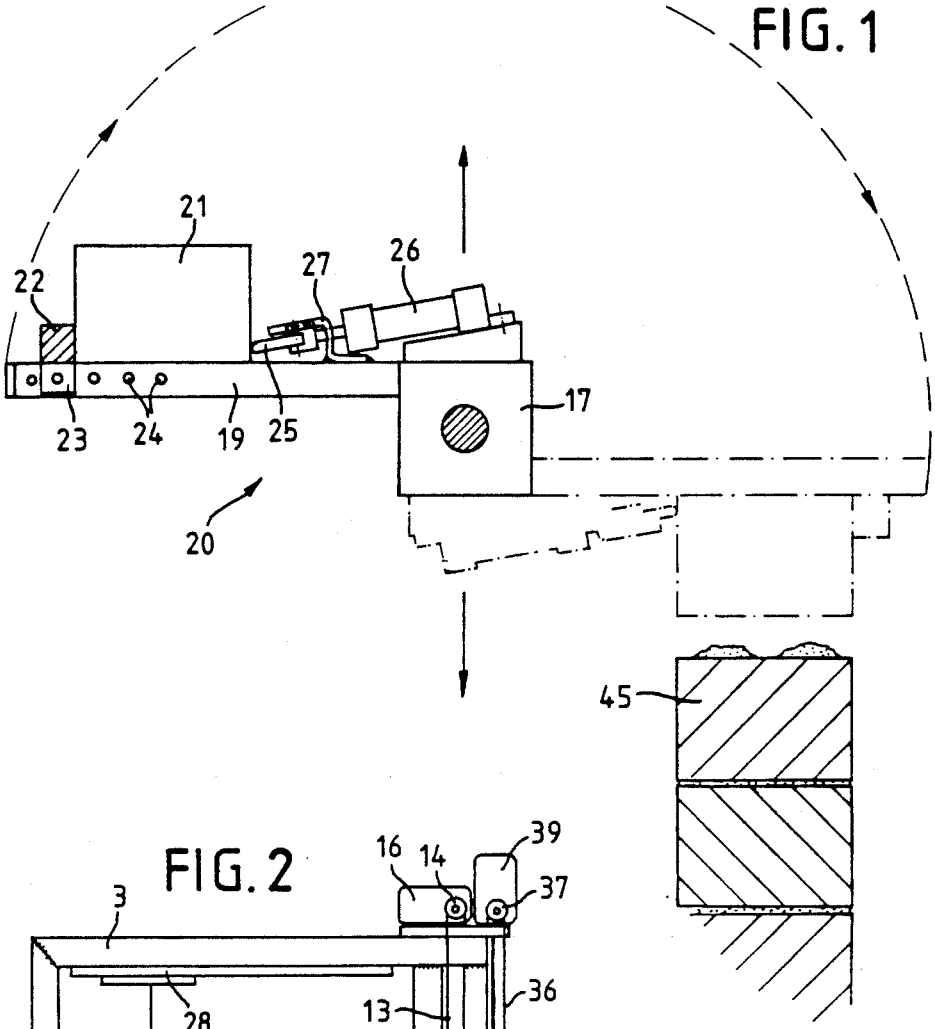
FIG. 1 shows a cross-section of the turnover table for explaining the basic concept of the invention.

The details of the turnover table 20 follow from FIG. 1. In the initial position shown in solid lines, building blocks 21 are laid onto the turnover table 20. A stop bar 22 extends along that longitudinal edge of the turnable 20 which is remote from the turnover shaft. The fixing lugs 23 of the which stop bar 22 engage between the flat bars 19. In interaction with bolts or cotter pins, a row 24 of holes in the relevant flat bars enables the stop bar 22 to be adjusted parallel to itself according to the width of the building blocks 21 used. The latter are laid directly against the stop bar 22 and are thereby accurately aligned.

For firmly clamping the building blocks 21, flat clamping jaws 25 are used which extend in the longitudinal direction of the table and are in each case connected at their centre to the piston rod of a pneumatic cylinder 26. The cylinders 26 and the clamping jaws 25 are arranged at an inclined angle with respect to the turnover table 20 in such a way that the building block 21, which is only gripped in its lower edge area, is pressed onto the turnover table. Guides 27 which consist of flat steel bars bent at an angle and which are welded to the turnover table 20 are placed over the clamping jaws 25 and prevent the clamping jaws from turning together with the piston rod. A total of 28 pneumatic cylinders 26 and clamping jaws 25 are provided, which in FIGS. 3 and 4 are mainly indicated only by their centre lines. The clamping jaws are about 25 cm long and follow one another at a distance of only a few centimeters.

The turnover table 20 is loaded by means of an overhead travelling crane 28, indicated in FIG. 2, with the grab 29 of which the building blocks can be removed from the building block supply 30. The supply is delivered on pallets which are deposited on a pallet grid 31 of the gantry framework.

Finally, a mortar-application device is attached to the gantry framework, the main component of the mortar-application device is a round mortar-supply container 32. It can be horizontally moved on a longitudinally extended frame, designated overall as 33, which has two longitudinal girders 34 and 35. The frame 33 extends in front of the gantry framework, hangs on chains 36 and is vertically guided on the double supports of the gantry framework by means of small rollers. The chains 36 wind around one chain wheel 37 each. The chain wheels 37 are driven together by a geared motor 39 via a shaft 38. For its horizontal movement, the mortar-supply container 32 is connected to an endless rope (not shown in detail) which is moved by a rope motor 40. Moreover, the mortar-supply container is pivotably mounted about its vertical centre axis in the frame 33.

At its lower end is arranged a horizontal mortar-discharge pipe 41 which contains a screw conveyor, so that the mortar discharges at a spout 42 having an adjustable opening width. If a bead of mortar is laid during an outward travel of the mortar-supply container 32 along the frame 33, a second bead can be laid next to it by a slight swivelling movement of the mortar-discharge pipe 41 in the reverse direction during the return travel. The extent of the swivelling movement, controlled by a pneumatic swivelling cylinder 43 (FIG. 3), determines the spacing of the mortar beads. An ultrasonic sensor 46, which is fixed on the travelling frame of the mortar-supply container 32, transmits signals in a direction vertical to the wall. It runs approximately next to the spout 42 and stops the outflow of mortar if the signals do not strike a building block.

The individual drive movements are controlled with electrical or electronic auxiliary means known per se. The timing sequences are also partly interlinked. For both the turnover table 20 and the frame 33, certain storey heights and intermediate heights in the spacing of the individual layers of the wall slab to be erected are firmly programmed in accordance with the height of the building blocks used plus the mortar seams. Inductive transmitters which interact with adjustable, metal probe fingers are mainly used as the limit switches.

In brief, work is carried out with the device described, preferably with one operator, as follows. At the start, the frame 33 is located in its lowermost vertical position, that is, one block height deeper than shown in FIG. 2. The turnover table 20, as shown in FIG. 2, is located in the initial position, namely at the loading height convenient for working, into which it returns after each swivelling operation. The working operation starts with the preparation of a mortar bed for the first layer of blocks. As usual, a strip of roofing paper is laid out on the ground and then the mortar-supply container 32 on the frame 33 travels once backwards and forwards and lays two mortar beads onto the roofing paper. The frame 33 then travels one step higher into the position according to FIG. 2. The mortar container is now located at the extreme right-hand side (FIG. 4). A first row of building blocks 21 is then laid on the turnover table 20 and aligned at the stop bar 22. For orientating in the longitudinal direction of the table, corresponding marks can be made on the stop bar. Once loading is complete, the operator sends a control signal. This first of all places the pneumatic cylinders 26 under pressure, so that the clamping jaws 25 bear against the building blocks 21 and fix the latter on the turnover table. The complete building unit, consisting of the turnover table 20, turnover shaft 17, mounting plates 12 and geared motors 18, now travels downwards into a first vertical position. The swivelling movement of the turnover table through 180° to the right is now automatically initiated (FIG. 1). In the placement position (FIG. 1, chain-dotted) reached, the building blocks 21 hang about 10 cm above the ground surface. From here, the turnover table, with the mounting plates 12, lowers once again into lower vertical position to such an extent that the row of blocks is pressed fully into the mortar bed. The clamping jaws 25 are then released, the turnover table travels a short distance upwards into first vertical position, swivels back through 180° into the initial position and then travels up further to the loading height. The mortar-supply container 32, automatically coupled at the side, then travels backwards and forwards again and lays two mortar beads onto this layer of blocks (FIG. 2). The frame 33 then travels in preparation one further step higher.

Meanwhile, the reloading of the turnover table 20 can be started. If the second row of blocks has finally been laid and they have been checked for their longitudinal orientation, the operator again sends a signal. This first of all clamps the row of blocks on the turnover table 20, which then travels downwards into a second vertical position, turns over, and travels further down into a slightly lower vertical position to place the second row of blocks onto the first. The blocks are pressed onto the fresh mortar bed in the exact vertical direction. The clamping device is now released, whereupon the turnover table travels upwards a bit further into the second vertical position II, swivels back and finally reaches the loading height again. The second layer is then loaded again with mortar and the frame 33 moves upwards.

Since the loading height of the turnover table is located approximately between the second vertical position and a third vertical position, the turnover table, after the following third loading, does not travel downwards but upwards into the third vertical position. Here, it swivels, travels downwards into a slightly vertical position III, with the third layer of blocks being placed, the clamping devices open, the turnover table travels back into vertical position III, swivels back into the initial position and stops at the loading height. In this way, layer is applied upon layer of the relevant wall slab 45.

The building blocks are placed in each direction with maximum precision. The device can therefore also be used for placing high-precision aerated concrete blocks, with a suitable adhesive being used instead of mortar. The wall slab 45 is indicated in FIGS. 1, 2 and 4. In the example, it can be up to 8 meters long and 2.50 meters high. Instead of a wall of such a length, which can only be transported with difficulty, several short wall pieces which are at a slight distance from one another can also be erected at the same time in one plane.

After completion of a wall or several wall pieces erected at the same time, the gantry framework travels slightly further and the next wall then follows at a short distance.

A roller conveyor consisting of individual conveyor rollers 47 is shown in FIGS. 5 and 6. These are mounted on a foundation 48 at equal spacing with axes parallel to one another and are driven by individual electric motors 49. These conveyor rollers 47 project into the intermediate spaces between the flat bars 19 of the turnover table 20 and, in the illustrated inoperative position of the turnover table, extend slightly beyond the upper edges 50 of the flat bars 19. In this position of the turnover table, therefore, the building blocks indicated in chain-dotted lines can be moved automatically into their correct position on the turnover table. As soon as the turnover table swivels just slightly upwards, the conveyor rollers 47 remain behind and the blocks are laid onto the turnover table. They are now firmly held between the stop bar 22 and the clamping jaws 25, so that the turnover table 20 can execute its swivelling movement.

1—Travelling roller
2—Longitudinal girder
3—Longitudinal girder
4—Support
5—Support
6—Support
7—Cross girder
8—Cross girder 9—Cross girder
10—Cross girder
11—Travelling mechanism
12—Bearing plate
13—Chain
14—Chain wheel
15—Shaft
16—Geared motor (lifting)
17—Turnover shaft
18—Geared motor (turning over)
19—Flat bar
20—Turnover table
21—Building block
22—Stop bar
23—Fixing lug
24—Row of holes
25—Clamping jaw
26—Pneumatic cylinder
27—Guide
28—Overhead travelling crane
29—Grab
30—Building block supply
31—Pallet grid
32—Mortar-supply container
33—Frame
34—Longitudinal girder
35—Longitudinal girder
36—Chain
37—Chain wheel
38—Shaft
39—Geared motor (lifting the frame 33)
40—Rope motor (moving the mortar-supply container)
41—Mortar-discharge pipe
42—Spout
43—Swivel cylinder
44—1st Layer
45—Wall slab
46—Ultrasonic sensor
47—Conveyor roller
48—Foundation
49—Electric motor
50—Upper edge

I claim:

1. A device for building wall slabs from building blocks comprising (a) a horizontally movable gantry framework;

(b) a turnover table comprising means for holding a row of the building blocks;

(c) a horizontal shaft having opposite ends;

(d) bearings guidable vertically and vertically adjustably in said gantry framework; said shaft being supported at said opposite ends in said bearings;

(e) means for attaching said turnover table to said shaft as a cantilever;

(f) drive means for turning the shaft, together with said turnover table, through an angle of 180° ;

(g) a clamping device attached to said turnover table; said clamping device including (1) a stop bar extending in a longitudinal direction;

(2) a plurality of clamping jaws arranged to press towards the stop bar transversely to said longitudinal direction; and (3) a plurality of lifting cylinders operatively connected to said clamping jaws for actuating said clamping jaws; each said lifting cylinder being oriented at an inclined angle to said turnover table in a feed direction.

2. Device according to claim 1, wherein the stop bar is adjustable parallel to itself in the transverse direction on the turnover table.

3. Device according to claim 1, wherein, the gantry framework has a supply base for the building blocks and an overhead travelling crane with a grab for individual building blocks.

4. Device according to claim 1, further comprising a roller conveyor conveying in the longitudinal direction for loading the turnover table.

5. Device according to claim 1, further comprising a mortar-application device guided on a horizontal frame for vertical motion on the gantry framework; said mortar application device being arranged for movement backwards and forwards above a wall slab in the longitudinal direction.

6. Device according to claim 5, wherein the mortar-application device has a mortar-supply container and a mortar-discharge pipe swivellable about a vertical axis; said mortar-discharge pipe being in one swivelling position during an outward travel and in another swivelling position during a return travel.

7. Device according to claim 5, further comprising a sensor for controlling the mortar discharge as a function of the presence or lack of building blocks in the uppermost layer.

* * * * *